US011524421B2

(12) United States Patent
Rae

(10) Patent No.: US 11,524,421 B2
(45) Date of Patent: Dec. 13, 2022

(54) FOLDING KNIFE

(71) Applicant: Bud K Worldwide, Inc., Moultrie, GA (US)

(72) Inventor: Kit Rae, Kodak, TN (US)

(73) Assignee: Bud K Worldwide, Inc., Moultrie, GA (US)

( * ) Notice: Subject to any disclaimer, the term of this patent is extended or adjusted under 35 U.S.C. 154(b) by 31 days.

(21) Appl. No.: 17/203,981

(22) Filed: Mar. 17, 2021

(65) Prior Publication Data

US 2022/0297325 A1 Sep. 22, 2022

(51) Int. Cl.
*B26B 29/02* (2006.01)
*B26B 1/04* (2006.01)
*B25G 1/10* (2006.01)

(52) U.S. Cl.
CPC ..... *B26B 29/02* (2013.01); *B25G 1/102* (2013.01); *B26B 1/044* (2013.01)

(58) Field of Classification Search
None
See application file for complete search history.

(56) References Cited

U.S. PATENT DOCUMENTS 6,289,592 B1 * 9/2001 Emerson ..... B26B 1/046 30/344
D756,193 S * 5/2016 Horvath ..... D8/99
9,339,940 B2 * 5/2016 Pelton ..... B26B 11/00
10,737,400 B2 * 8/2020 Caswell ..... F41B 13/00
10,913,168 B1 * 2/2021 Salvitti ..... B26B 1/04
2001/0016987 A1 * 8/2001 Chen ..... B26B 1/048 30/151
2003/0041460 A1 * 3/2003 Frank ..... B26B 1/04 30/151
2012/0234142 A1 * 9/2012 Onion ..... B26B 1/044 30/155
2015/0224652 A1 * 8/2015 Irvin ..... F41B 13/00 30/298
2018/0021963 A1 * 1/2018 Liao ..... B26B 1/048 30/161
2018/0154531 A1 * 6/2018 Caswell ..... F41B 13/00
2022/0297325 A1 * 9/2022 Rae ..... B25G 1/102

* cited by examiner

*Primary Examiner* — Hwei-Siu C Payer
(74) *Attorney, Agent, or Firm* — Fox Rothschild LLP

(57) ABSTRACT

A folding knife having an elongated handle defining a finger hole proximate one end of the handle and a blade having a cutting edge and pivotally connected to the handle and configured to move with respect to the handle between a retracted position and an extended position. The blade is configured such that a portion of the cutting edge extends into the finger hole upon the blade being in the retracted position. A blade cover is connected to the handle and is configured to move between an operable position and a withdrawn position. A spring is configured to contact and automatically move the blade cover from the operable position towards the withdrawn position, whereby, as the blade reaches the retracted position, the blade cover is automatically moved to the operable position and covers the portion of the cutting edge of the blade extending into the finger hole, and upon the blade moving towards the extended position, the spring automatically moves the blade cover from the operable position towards the withdrawn position.

20 Claims, 5 Drawing Sheets

FOLDING KNIFE

FIELD

The present invention relates generally to folding knives, and more particularly to folding karambit knives.

BACKGROUND

Folding knives, and in particular folding karambit knives, often feature a handle having a finger hole or ring at one end of the handle and a blade pivotally connected to the other end of the handle for pivoting between a retracted, or closed, position generally within the handle, and an extended, or opened, operational position extending outwardly from the handle. The user has the option to insert a finger or thumb into the finger hole upon the blade being in the opened position in order facilitate the user's grip on the knife's handle during use, and in particular, to reduce the likelihood of the knife being wrested or otherwise removed from the user's grip during use.

Typically in such knives, the length of the blade is short blade in comparison to the handle, such that the blade and its sharpened edge does not extend into the finger hole, in order to prevent the sharpened edge from injuring the user upon the user's finger being inserted into the finger hole.

Accordingly, providing a folding karambit knife where the blade is longer as compared to the length of the handle, without unduly risking exposure of the user to the sharpened edge of the blade upon the user's finger being inserted into the finger hole may be desirable.

SUMMARY

Generally, implementations of the present disclosure include an apparatus comprising a movable blade cover, or guard, which projects into the finger hole and covers the cutting edge of the blade upon the blade being in the closed position and is movable to a retracted position substantially outside of the finger hole upon the blade being in the opened position. By safely allowing the blade to extend into the finger hole, the blade guard apparatus effectively allows for a blade to have a length more commensurate with the length of a knife handle than may be the case with other folding karambit knives.

Implementations of the present disclosure may include a folding knife, including an elongated handle having a first end and a second end and defining a finger hole proximate the second end. A blade is provided having a cutting edge and a tang portion, the tang portion being pivotally connected proximate to the first end of the handle, and the blade being configured to move with respect to the handle between a retracted position and an extended position; the blade being configured such that a portion of the cutting edge extends into the finger hole upon the blade being in the retracted position. A blade cover is connected to the handle and configured to move between an operable position and a withdrawn position, and a spring is configured to contact and automatically move the blade cover from the operable position towards the withdrawn position, whereby, as the blade moves to the retracted position, the blade cover is automatically moved to the operable position and covers the portion of the cutting edge of the blade extending into the finger hole, and upon the blade moving towards the extended position, the spring automatically moves the blade cover from the operable position towards the withdrawn position.

Implementations of the present disclosure may also include a folding knife further comprising one or more of the following: a first blade lock for locking the blade in the extended position, where the first blade lock could be a liner lock; a second blade lock for locking the blade in the retracted position, where such second blade lock could include the blade having a ball bearing and the liner lock having a ball detent configured to receive and releasably engage the ball bearing upon the blade being in the retracted position.

Implementations of the present disclosure may further include the spring for such folding knife being a torsion spring.

Additional implementations of the present disclosure may include the tang portion having a flipper configured to facilitate a user moving the blade from the retracted position to the extended position.

Still further implementations of the present disclosure may include the blade cover defining a channel configured to receive the portion of the cutting edge of the blade extending into the finger hole upon the blade being in the retracted position.

Other implementations of the present disclosure may include a guard apparatus for a folding knife having a handle defining a finger hole and a blade having a cutting edge pivotally connected to the handle for moving between extended and retracted positions and also configured such that a portion of the cutting edge extends into the finger hole upon the blade being in the retracted position. The guard apparatus includes a blade cover connected to the handle and configured to move between an operable position and a withdrawn position. A spring is configured to contact and automatically move the blade cover from the operable position towards the withdrawn position, whereby, as the blade reaches the retracted position, the blade cover is automatically moved to the operable position and covers the portion of the cutting edge of the blade extending into the finger hole, and upon the blade moving towards the extended position, the spring automatically moves the blade cover from the operable position towards the withdrawn position.

Yet other implementations of the present disclosure may include a folding knife having an elongated handle with a first end and a second end and defining a finger hole proximate the second end, and a blade having a cutting edge and a tang portion. The tang portion is pivotally connected proximate to the first end of the handle, and the blade is configured to move with respect to the handle between a retracted position and an extended position. The blade is configured such that a portion of the cutting edge extends into the finger hole upon the blade being in the retracted position. A first blade lock is provided for locking the blade in the extended position, and a second blade automatically locks the blade in the retracted position. A blade cover is connected to the handle and is configured to move between an operable position and a withdrawn position, and a spring is configured to contact and automatically move the blade cover from the operable position to or towards the withdrawn position, whereby, as the blade moves to and reaching the retracted position, the blade cover is automatically moved to the operable position and covers the portion of the cutting edge of the blade extending into the finger hole, and upon the blade moving towards the extended position, the spring automatically moves the blade cover from the operable position towards the withdrawn position.

The features, functions, and advantages that have been discussed herein can be achieved independently in various examples or may be combined in yet other examples, further details of which can be seen with reference to the following description and drawings.

BRIEF DESCRIPTION OF THE DRAWINGS

The drawings referenced herein form a part of the specification. Features shown in the drawings are meant as illustrative of some, but not all, embodiments of the present disclosure, unless otherwise explicitly indicated, and implications to the contrary are otherwise not to be made. Although in the drawings like reference numerals correspond to similar, though not necessarily identical, components and/or features, for the sake of brevity, reference numerals or features having a previously described function may not necessarily be described in connection with other drawings in which such components and/or features appear.

DETAILED DESCRIPTION

The accompanying drawings and the description which follows set forth this invention in several of its preferred embodiments. However, it is contemplated that persons generally familiar with knives will be able to apply the novel characteristics of the structures illustrated and described herein in other contexts by modification of certain details. Accordingly, the drawings and description are not to be taken as restrictive on the scope of this invention, but are to be understood as broad and general teachings.

Figure 1:
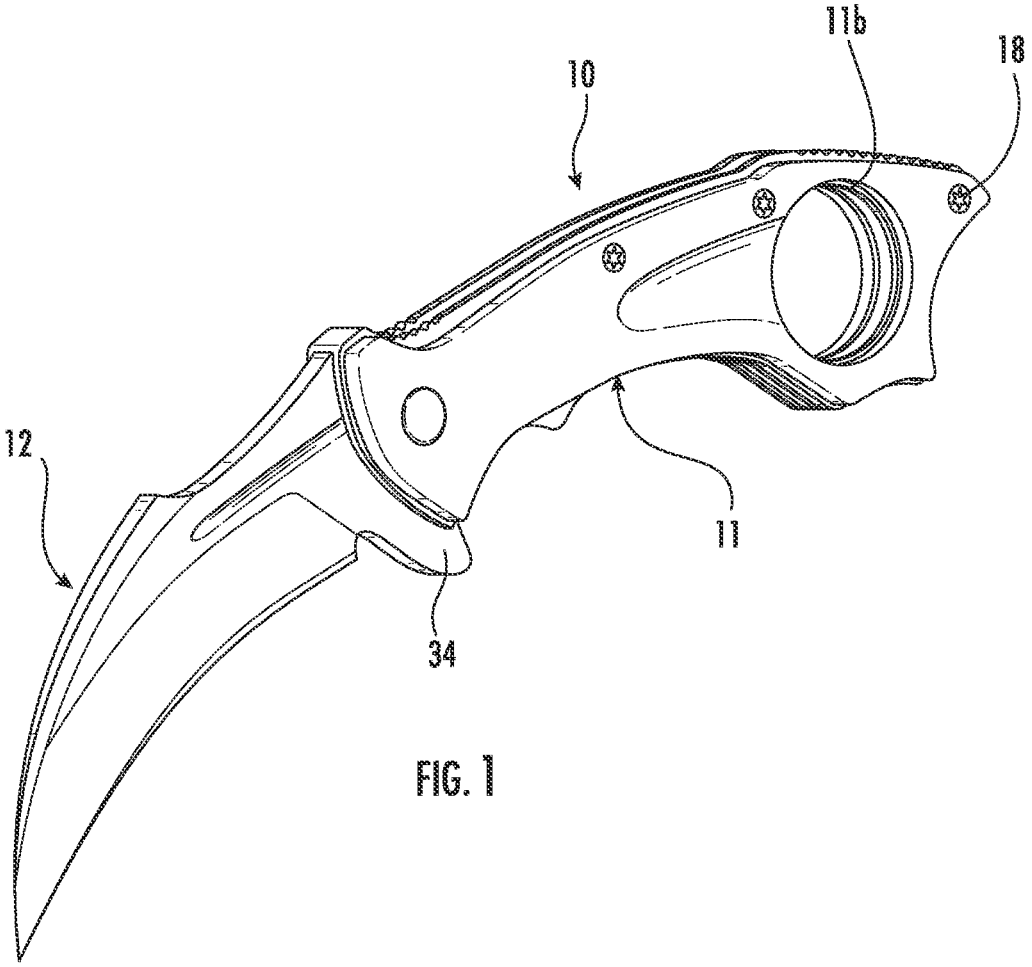
FIG. 1 is a perspective view of an example implementation of a folding knife of the present disclosure, with a blade in an opened position.
Figure 4:
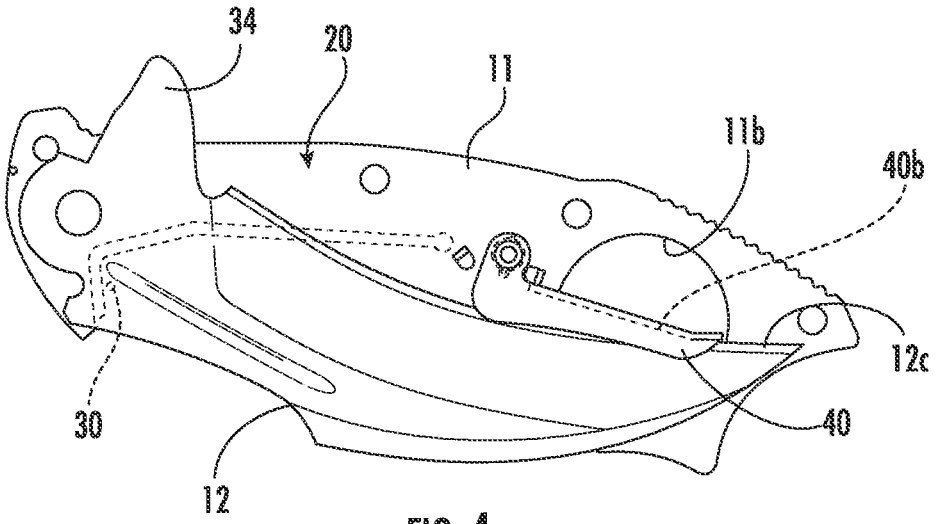
FIG. 4 is a side elevational schematic view, with parts cut away, of an example implementation of a folding knife of the present disclosure, with a blade in the closed position.
Figure 5:
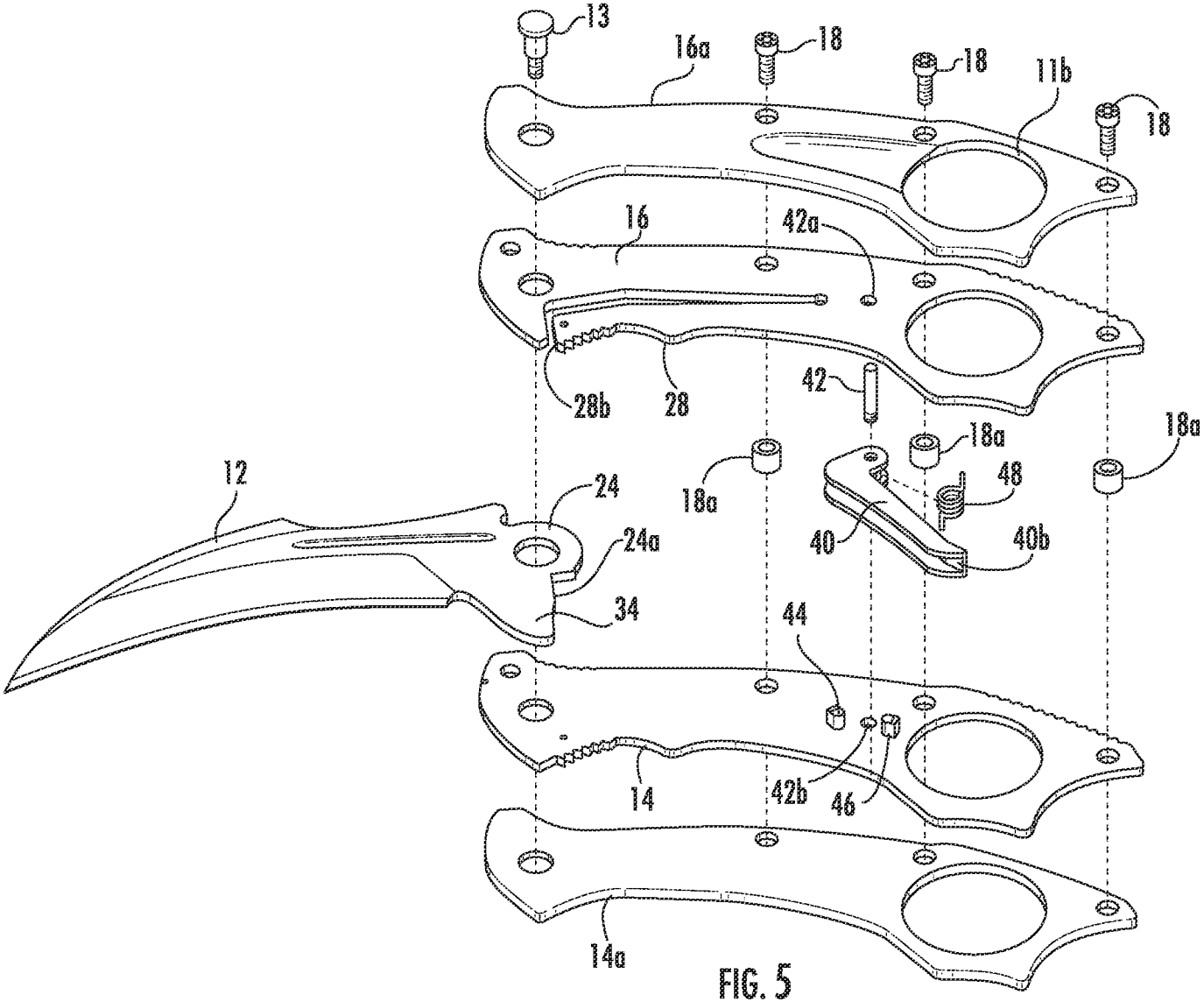
FIG. 5 is an exploded schematic view of an example implementation of a folding knife of the present disclosure, with a blade in an opened position.

Referring now to the drawings, wherein like reference numerals refer to like parts throughout the various views, as shown in FIGS. 1 and 5, an example implementation of the present disclosure may include a folding knife, designated generally by reference numeral 10, comprising a handle, generally 11, and a blade 12 having a free end 12*a* and an opposite end 12*b* pivotally connected by a blade pivot, axle, or pin, 13 passing through a hole in end 12*b*. Blade 12 pivots about pin 13 between a closed position generally within the handle (FIG. 4), and an opened, operational, position extending outwardly from the handle (FIG. 1). A second end of the handle 11 includes an opening, or finger hole, 11*b* configured to receive at least one of the user's fingers and/or thumb to help secure the user's grasp of knife 10 upon use.

Blade 12 includes at least one sharpened edge, or cutting edge, 12*c* extending at least partially between free end 12*a* and end 12*b*. As shown in FIG. 5, handle 11 includes first and second handle members, or liners, 14, 16, respectively, that are held in spaced, parallel relation to one another by assembly screws 18. First and second handle members, or scales, 14*a*, 16*a*, are adjacent first and second liners, 14, 16, respectively. Assembly screws 18 attach first and second handle scales, 14*a*, 16*a* to first and second liners, 14, 16, respectively, and also join first and second handle scales, 14*a*, 16*a* and first and second liners, 14, 16 together, in a manner spaced apart by spacer elements 18*a* and configured to define a passage, groove, slot, or channel, generally 20 (FIG. 4), therebetween for selectively receiving the blade 12 therein upon blade 12 being in the retracted position. A pin 18*b* (FIG. 2) in handle 11 acts as a blade stop through engagement with notch 12*d* in blade 12 when blade 12 is in the extended, operable position.

Blade 12 includes a tang portion 24 and is attached at the tang portion 24 to handle 11 by a pivot pin, or blade screw, 13 for pivotal movement between the extended, or opened, (operable) position and the retracted, or closed, position extending within the channel 20.

Knife 10 further comprises a first blade lock arrangement for locking blade 12 in its extended position. The blade lock arrangement in one implementation of knife 10 comprises a liner lock, generally 28, wherein the second liner 16 includes an elongated portion 28*a* which acts essentially as a cantilevered leaf spring having a free end 28*b* and an opposite end attached to, or integral with, second liner 16. Liner lock 28 is configured such that upon blade 12 being in the extended position, free end 28*b* of elongated portion 28*a* is biased into engaged relation, where free end 28*b* abuts an edge 24*a* (FIG. 5) of tang portion 24, and such abutment prevents pivotal movement of the blade 12 towards the retracted position of blade 12. Disengagement of liner lock 28 is accomplished by manually moving free end 28*a* out of engagement with edge 24*a* of tang portion 24 by depressing elongated portion 28*b* towards second handle scale 16*a*. Blade 12 can then simultaneously be manually pivoted such that the elongated portion 28*a* generally contacts tang portion 24, but does not in a manner sufficient to prevent pivotal movement of blade 12 to its retracted position.

Knife 10 also includes in one implementation a second locking arrangement configured to lock or restrain blade 12 from inadvertently moving outwardly from the channel 20 when in the retracted position. More specifically, in one example implementation, blade 12 includes a protuberance, such as a ball bearing, 30 (FIG. 4) which is received by a ball bearing detent 32 located in liner lock portion 28*a* proximate the free end 28*b*. Given the liner lock portion 28*a* is normally spring-biased outwardly towards the channel 20, the liner lock portion 28*a* is forced against the tang portion 24 upon the blade 12 being in the retracted position, causing the ball bearing detent 32 to firmly receive and releasably engage the ball bearing 30 in the tang portion 24 and to thereby act to restrain blade in the retracted position and against inadvertent movement therefrom, i.e., generally a deliberate force would be needed, such as the force applied by a user to intentionally engage and move the blade 12 towards the extended, or opened, position.

In one example implementation, blade 12 includes a projection, or flipper, 34 connected to tang portion 24 and extends outwardly from tang portion 24 beyond handle 11 when blade 12 is in the retracted position. When the user desires to use the blade 12 in the opened, or operable, position, the user may press on the flipper 34 in a direction towards the free end 12*a* of blade 12 such that flipper 34 acts as a lever about blade pivot pin 13 to move the blade 12 towards the opened position. Once the blade 12 is in the fully opened position, it is automatically locked in place by the engagement of the free end 28*a* of the liner lock 28 with the edge 24*a* of blade tang portion 24.

Figure 2:
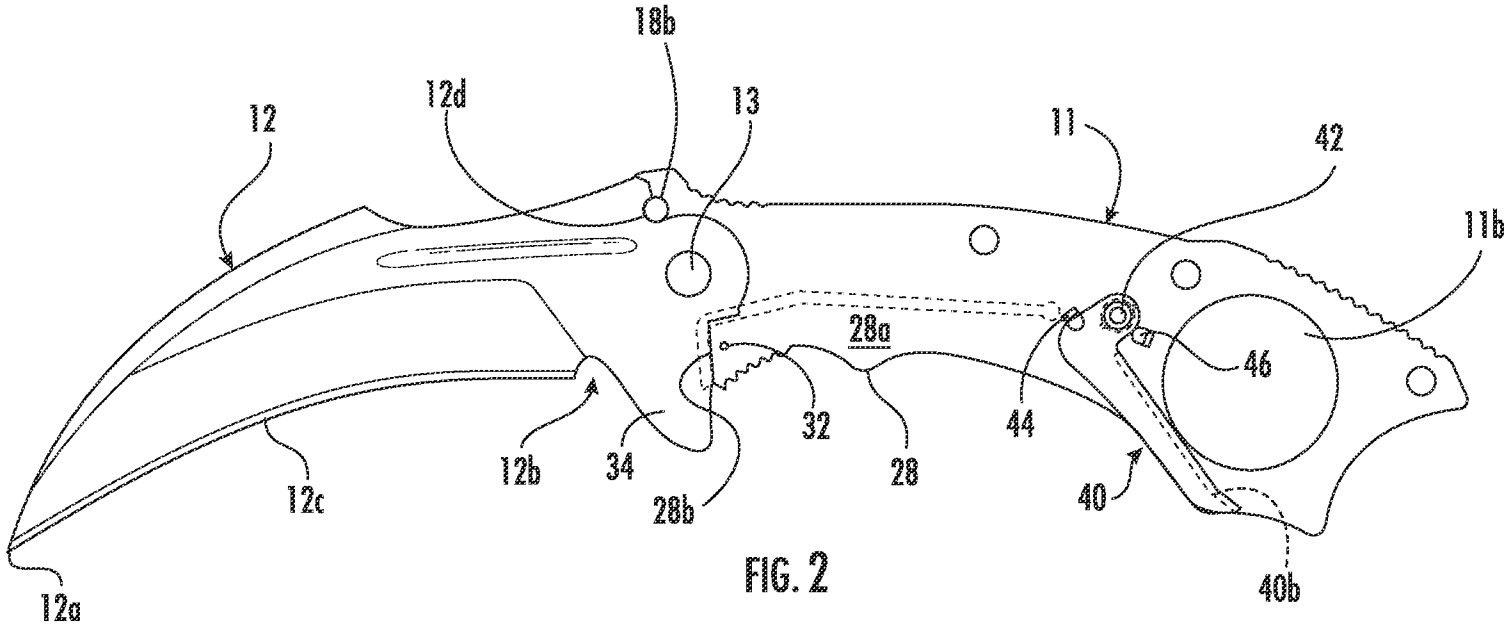
FIG. 2 is a side elevational schematic view, with parts cut away, of an example implementation of a folding knife of the present disclosure, with a blade in an opened position.
Figure 6:
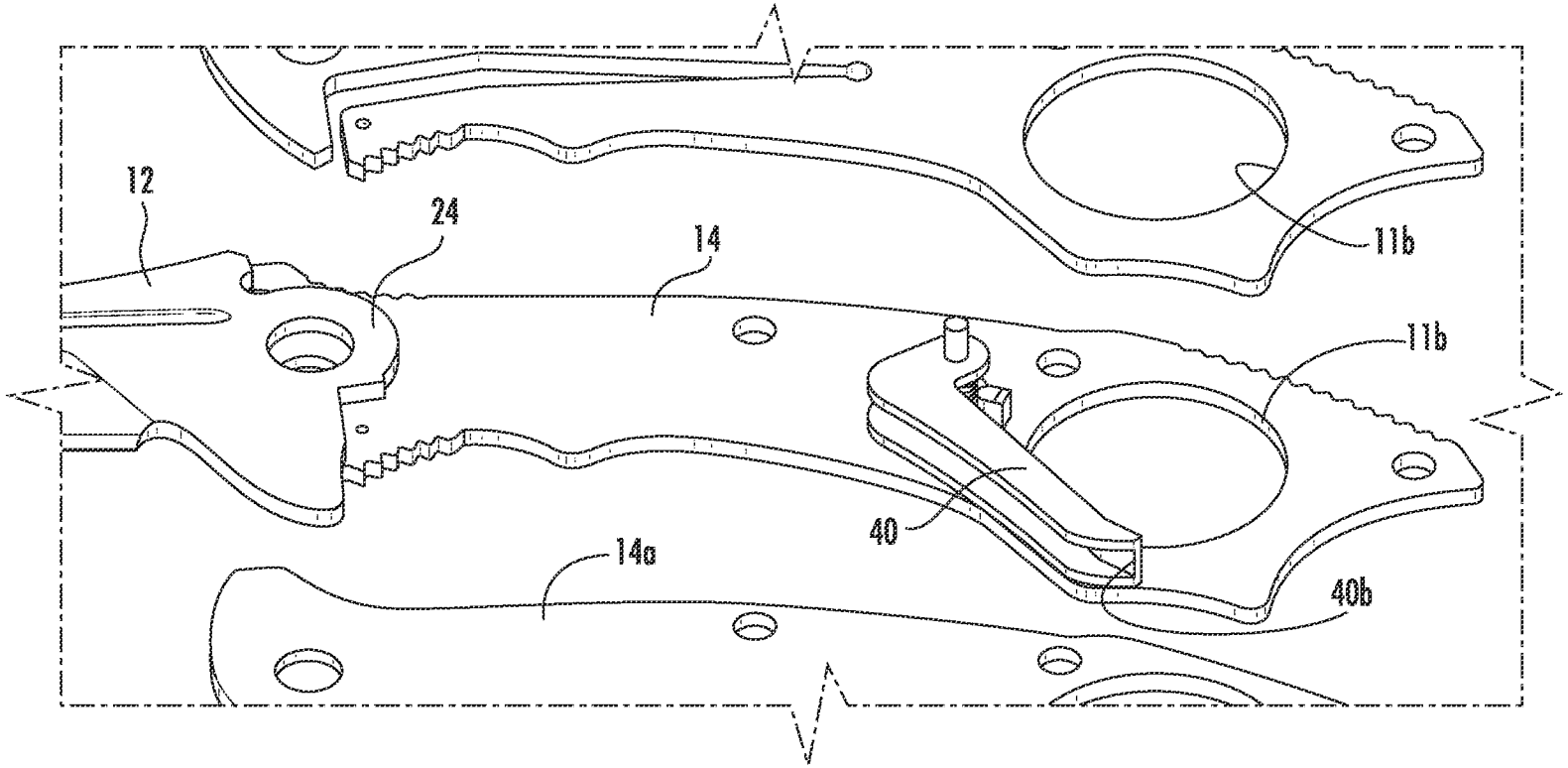
FIG. 6 is a partial exploded view of an example implementation of a folding knife of the present disclosure.

In one example implementation of the present disclosure, a blade guard apparatus is provided including an elongated guard, or cover, generally 40, which includes at a first end a hole through which an axle pin 42 passes to allow blade cover 40 to pivot with respect to liners 14, 16. Axle pin 42 is received at its two ends in hole 42*a* of liner 16 and hole 42*b* in liner 14. More specifically, blade cover 40 is pivotable between an operational position, where it extends into finger hole 11*b* (FIG. 4), and a retracted position where, blade cover 40 is substantially outside of finger hole 11*b* (FIGS. 2 and 6). Upon the user moving blade 12 from the extended position towards the retracted position, blade 12 engages and also moves the blade cover 40 from the blade cover's withdrawn position towards the blade cover's operable position against the force of spring 48, and upon the blade 12 reaching the retracted position, the blade cover 40 has thus been automatically moved by blade 12 to the operable position and substantially covers the portion of the cutting edge 12*c* of the blade 12 extending into the finger hole 11*b*. Upon blade cover 40 being in the operational position and blade 12 being in a retracted position, sharpened blade edge 12*c* is received in channel 40*b* of blade cover 40, and blade cover 40 effectively shields blade edge 12*c* from exposure within finger hole 40*b*, thereby protecting the user from injury by edge 12*c* should the user's finger be inserted into finger hole 11*b* during use of knife 10.

Upon blade 12 being moved from the retracted position towards the extended position, blade cover 40 substantially follows blade 12 under the force of a biasing arrangement, such as a coil spring, leaf spring, torsion spring, elastic band, or some other suitable biasing element or elements (the foregoing collectively referred to herein as a "spring"). In one example implementation the spring is a torsion spring 48 which encircles pin 42 and which contacts and urges blade cover 40 towards the retracted position of blade cover 40. Generally simultaneously with blade edge 12*c* clearing finger hole 40*b*, i.e., blade edge 12*c* no longer intruding into finger hole 11*b*, blade cover 40 moves or pivots under the force of spring 48 such that blade cover 40 substantially no longer intrudes into finger hole 40. Continued pivoting of blade 12 towards the blade's retracted position allows spring 48 to eventually urge blade cover to a limit post 44, against which blade cover 40 stops, as blade cover 40 is then in the withdrawn position. Similarly, limit post 46 serves to stop further intrusion of blade cover 40 into finger hole 11*b* than is necessary to cover blade edge 12*c* upon blade 12 being in the retracted position.

It is to be understood that while blade cover 40 is depicted as pivoting in order to selectively cover blade edge 12*c*, blade cover could move in a motion other than a pivoting motion, if desired. For example, blade cover could move rectilinearly and/or obliquely to cover the intrusion of blade edge 12*c* into the finger hole 11*b*, if desired.

As can be seen from the foregoing, implementations of the present disclosure provide a folding knife 10, and also a guard apparatus for a folding knife, where the folding knife has a handle 11 defining a finger hole 11*b* and a blade 12 having a cutting edge 12*c* pivotally connected to the handle 11 for moving between an extended and a retracted position and also configured such that a portion of the cutting edge 12*c* extends into the finger hole 11*b* upon the blade being in the retracted position.

Figure 3:
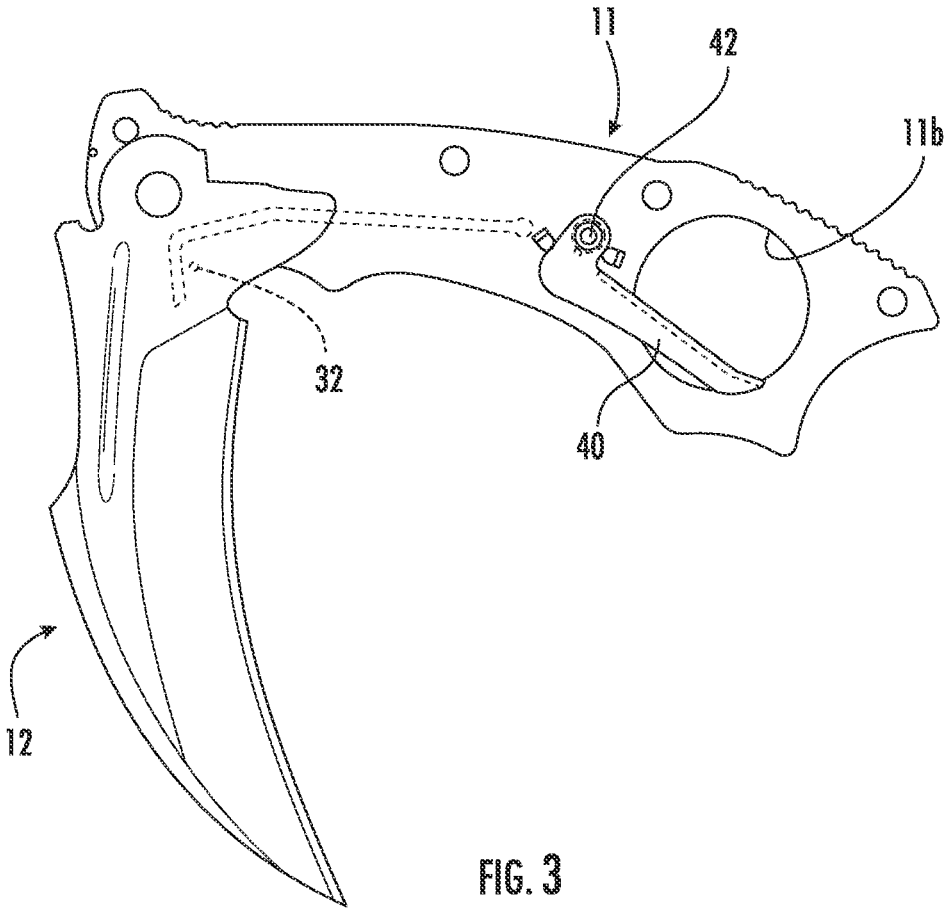
FIG. 3 is a side elevational schematic view, with parts cut away, of an example implementation of a folding knife of the present disclosure, with a blade in an intermediate position between the opened position and a closed position.

The blade cover 40 of the guard apparatus moves between an operable position and a withdrawn position, and spring 48 automatically moves the blade cover 40 from the operable position to or towards the withdrawn position. Upon the blade 12 moving towards the retracted position, it engages and also moves the blade cover 40 from an intermediate position (FIG. 3) between the withdrawn and operable positions, thereby automatically moving blade cover 40 from the intermediate position towards the blade cover's operable position against the force of spring 48. Upon the blade 12 reaching the retracted position, the blade cover 40 has thus been automatically moved to the operable position and substantially covers the portion of the cutting edge 12*c* of the blade 12 extending into the finger hole 11*b*. And, upon the blade 12 moving towards the extended position, the spring 48 automatically moves the blade cover 40 from the operable position to or towards the withdrawn position. By safely allowing the blade 12 to extend into the finger hole 11*b*, the blade guard apparatus effectively allows for blade 12 to have a length more commensurate with the length of a knife handle than may be the case with other folding karambit knives.

Many modifications and other examples of the disclosure set forth herein will come to mind to those skilled in the art to which this disclosure pertains, having the benefit of the teachings presented in the foregoing descriptions and the associated drawings. Therefore, it is to be understood that the disclosure is not to be limited to the specific examples disclosed and that modifications and other embodiments are intended to be included within the scope of the appended claims.

Moreover, although the foregoing descriptions and the associated drawings describe aspects of the disclosure in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A folding knife, comprising:

an elongated handle having a first end and a second end and defining a finger hole proximate the second end;

a blade having a cutting edge and a tang portion, the tang portion being pivotally connected proximate to the first end of the handle, and the blade being configured to move with respect to the handle between a retracted position and an extended position; the blade being configured such that a portion of the cutting edge extends into the finger hole upon the blade being in the retracted position;

a blade cover connected to the handle and configured to move between an operable position and a withdrawn position;

a spring configured to contact and automatically move the blade cover from the operable position towards the withdrawn position; and whereby, as the blade reaches the retracted position, the blade cover is automatically moved to the operable position and substantially covers the portion of the cutting edge of the blade extending into the finger hole, and upon the blade moving towards the extended position, the spring automatically moves the blade cover from the operable position towards the withdrawn position.

2. The folding knife according to claim 1, further comprising a first blade lock for locking the blade in the extended position.

3. The folding knife according to claim 2, further comprising a second blade lock for locking the blade in the retracted position.

4. The folding knife according to claim 3, wherein the first blade lock comprises a liner lock.

5. The folding knife according to claim 4, wherein the second blade lock comprises the blade having a ball bearing and the liner lock having a ball detent configured to receive and releasably engage the ball bearing upon the blade being in the retracted position.

6. The folding knife according to claim 1, wherein the spring comprises a torsion spring.

7. The folding knife according to claim 1, further comprising the tang portion having a flipper configured to facilitate a user moving the blade from the retracted position to the extended position.

8. The folding knife according to claim 1, further comprising the blade cover defining a channel configured to receive the portion of the cutting edge of the blade extending into the finger hole upon the blade being in the retracted position.

9. A guard apparatus for a folding knife having a handle defining a finger hole and a blade having a cutting edge pivotally connected to the handle for moving between an extended and a retracted position and also configured such that a portion of the cutting edge extends into the finger hole upon the blade being in the retracted position, the guard apparatus:

a blade cover connectable to the handle and configured to move between an operable position and a withdrawn position;

a spring configured to contact and automatically move the blade cover from the operable position towards the withdrawn position; and whereby, as the blade reaches the retracted position, the blade cover is automatically moved to the operable position and substantially covers the portion of the cutting edge of the blade extending into the finger hole, and upon the blade moving towards the extended position, the spring automatically moves the blade cover from the operable position towards the withdrawn position.

10. The guard apparatus according to claim 9, further comprising the blade cover defining a channel configured to receive the portion of the cutting edge of the blade extending into the finger hole upon the blade being in the retracted position.

11. The guard apparatus according to claim 9, wherein the spring comprises a torsion spring.

12. A folding knife, comprising:

an elongated handle having a first end and a second end and defining a finger hole proximate the second end;

a blade having a cutting edge and a tang portion, the tang portion being pivotally connected proximate to the first end of the handle, and the blade being configured to move with respect to the handle between a retracted position and an extended position; the blade being configured such that a portion of the cutting edge extends into the finger hole upon the blade being in the retracted position;

a first blade lock for locking the blade in the extended position;

a second blade lock for locking the blade in the retracted position;

a blade cover connected to the handle and configured to move between an operable position and a withdrawn position;

a spring configured to contact and automatically move the blade cover from the operable position towards the withdrawn position; and whereby, as the blade reaches the retracted position, the blade cover is automatically moved to the operable position and substantially covers the portion of the cutting edge of the blade extending into the finger hole, and upon the blade moving towards the extended position, the spring automatically moves the blade cover from the operable position towards the withdrawn position.

13. The folding knife according to claim 12, wherein the first blade lock comprises a liner lock.

14. The folding knife according to claim 13, wherein the second blade lock comprises the blade having a ball bearing and the liner lock having a ball detent configured to receive and releasably engage the ball bearing upon the blade being in the retracted position.

15. The folding knife according to claim 12, wherein the spring comprises a torsion spring.

16. The folding knife according to claim 12, further comprising the tang portion having a flipper configured to facilitate a user moving the blade from the retracted position to the extended position.

17. The folding knife according to claim 12, further comprising the blade cover defining a channel configured to receive the portion of the cutting edge of the blade extending into the finger hole upon the blade being in the retracted position.

18. The folding knife according to claim 12, wherein:

the first blade lock comprises a liner lock; and the second blade lock comprises the blade having a ball bearing and the liner lock having a ball detent configured to receive and releasably engage the ball bearing upon the blade being in the retracted position.

19. The folding knife according to claim 12, further comprising:

the tang portion having a flipper configured to facilitate a user moving the blade from the retracted position to the extended position;

the first blade lock including a liner lock; and the second blade lock including the blade having a ball bearing and the liner lock having a ball detent configured to receive and releasably engage the ball bearing upon the blade being in the retracted position.

20. The folding knife according to claim 12, further comprising:

the tang portion having a flipper configured to facilitate a user moving the blade from the retracted position to the extended position;

the blade cover defining a channel configured to receive the portion of the cutting edge of the blade extending into the finger hole upon the blade being in the retracted position;

the first blade lock including a liner lock; and the second blade lock including the blade having a ball bearing and the liner lock having a ball detent configured to receive and releasably engage the ball bearing upon the blade being in the retracted position.

* * * * *